United States Patent [19]

Chlumecky

[11] Patent Number: 4,497,597

[45] Date of Patent: Feb. 5, 1985

[54] CRIBBING

[75] Inventor: Nicholas Chlumecky, Youngstown, Ohio

[73] Assignee: Commercial Shearing, Inc., Youngstown, Ohio

[21] Appl. No.: 411,583

[22] Filed: Aug. 25, 1982

[51] Int. Cl.[3] ..... E21D 11/00

[52] U.S. Cl. ..... 405/288; 52/423; 299/11; 405/258

[58] Field of Search ..... 405/288, 290, 258; 299/11, 19; 52/600, 601, 596, 725, 726, 727, 728, 297

[56] References Cited

U.S. PATENT DOCUMENTS

| | | | |
|---|---|---|---|
| 676,568 | 6/1901 | Mouchel | 405/229 X |
| 762,496 | 6/1904 | Smith | 52/423 |
| 931,466 | 8/1909 | Nellen | 405/288 X |
| 1,662,727 | 3/1928 | Wait | 405/229 X |
| 1,673,729 | 6/1928 | Barnes | 52/728 X |
| 2,451,777 | 10/1948 | Salas | 405/290 X |
| 2,698,519 | 1/1955 | Lloyd | 52/423 X |
| 3,109,259 | 11/1963 | Viall | 52/596 X |
| 3,638,384 | 2/1972 | Martin | 52/601 X |

*Primary Examiner*—Dennis L. Taylor

*Attorney, Agent, or Firm*—Buell, Ziesenheim, Beck & Alstadt

[57] ABSTRACT

A crib member for forming underground cribbing is provided in the form of a concrete annulus formed within at least one annular metal retaining member so as to form a donut shaped member. A plurality of such members is stacked one on top of another to form a cylindrical cribbing with a central hole.

8 Claims, 9 Drawing Figures

CRIBBING

This invention relates to cribbing and particularly to cribbing for mines, tunnels and similar underground passages.

Cribbing of mine roofs, tunnels and similar underground passages to provide roof support has long been practiced. Such cribbing has universally been done using cribs made by assembling wooden blocks in an open or closed generally square vertical crib between the floor and roof at regular intervals. Wood has been used for cribbing because it is compressible and is the most commonly available material. In general, efforts to use concrete or other materials have been unsuccessful because of brittle or catastrophic failure of materials other than wood. While wood has proven to be virtually the only satisfactory material available for cribbing to date, it does have the disadvantage of relatively low compressive strength and Young's modulus and the further disadvantage of non-uniformity from piece to piece of wood depending upon its source, character, cut and composition, flammability, rot and deterioration with passage of time.

The present invention provides a form of concrete crib member which overcomes all of the disadvantages associated with both prior art concrete and wood crib members and provides unique advantages not heretofore available in any form of crib member. The crib member of this invention provides a larger bearing area than conventional crib structures. It will not rot and is not flammable. There are no sharp corners which penetrate roof or floor. It has much less resistance to air flow around the cribbing. It will deform over longer distances under compression while still maintaining load capacity. It yields by spalling into a center hole and thus even after yielding to some degree will not detrimentally affect air flow. Finally, the crib of this invention is circular and can be rolled to the position of use, reducing labor and heavy handling which is of great advantage when working in low coal seams.

I provide a crib member in the form of a concrete annulus formed within at least one annular metal retaining member so as to form a donut shaped crib member. The concrete is preferably plain concrete but it may be fiber reenforced. Preferably the concrete is poured within a single steel retaining band extending the full thickness of the crib member. However, the metal retaining member may take the form of a band with inturned edges forming a generally C-shape or it may be a plurality of spaced reenforcing bars cast into the periphery of the concrete. The donut shaped concrete is preferably cast with a planar matching face on top and bottom, however, a mating tongue on one side and groove on the opposite side may be provided if desired.

In the foregoing general description of my invention I have set out certain objects, purposes and advantages of my invention. Other objects, purposes and advantages of this invention will be apparent from a consideration of the following description and the accompanying drawings in which.

Figure 1:
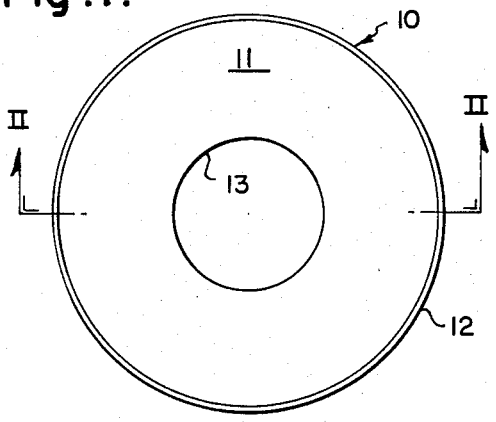
FIG. 1 is a top plan view of a crib member according to this invention.
Figure 2:
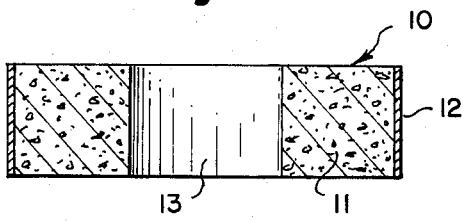
FIG. 2 is a section on the line II—II of FIG. 1.
Figure 3:
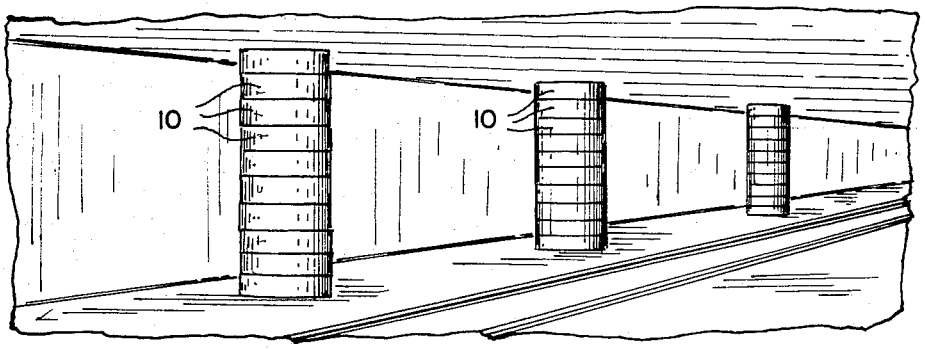
FIG. 3 is a side elevation of a cribbing formed in a mine using the crib member of FIGS. 1 and 2.
Figure 7:
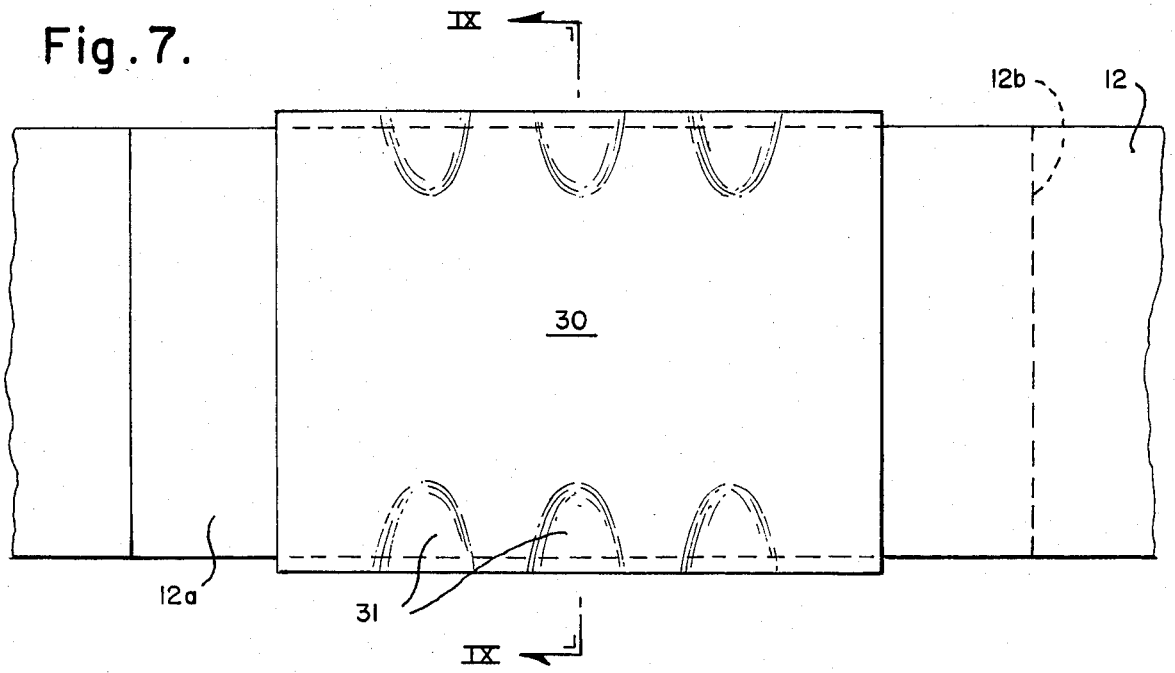
FIG. 7 is an enlarged fragmentary side elevational view of a preferred joint for the steel band around a crib member of this invention.
Figure 8:
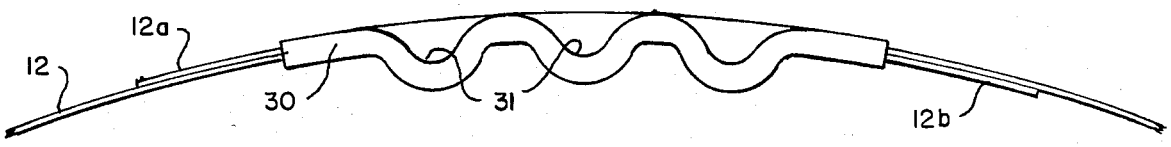
FIG. 8 is an enlarged fragmentary top plan view of the joint of FIG. 7.
Figure 9:
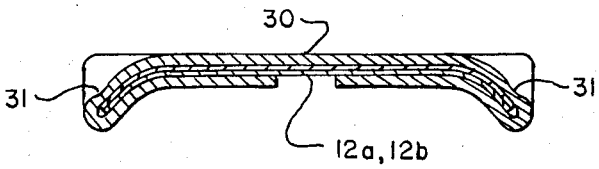
FIG. 9 is a section on the line IX—IX of FIG. 7.

Referring to FIGS. 1 and 2, I have illustrated a crib member 10 of concrete 11 cast within on outer steel band 12 whose width is the thickness of the concrete and with an opening 13 in the center thereof to form an annulus or donut of concrete 11 confined within steel band 12. The steel band 12 is preferably made as shown in FIGS. 7–9 inclusive by overlapping the ends **12*a* and 12*b* of a steel band, placing a steel strap 30 around the overlapped ends. The top and bottom edges of the band ends 12*a* and 12*b* together with the overlapping portions of steel strap 30 are then corrugated to form indentations 31 in succession along the edges. This connecting arrangement permits the cribbing to collapse gradually and yieldably rather than catastrophically. In use, the crib members may be rolled into place and stacked one upon another as shown in FIG. 3** from floor to roof to form a hollow cylindrical cribbing. If the pressure of the roof on the cribbing is great that yielding occurs, the concrete will not crack or break on the outside because of the metal reenforcement but will allow controlled yielding by spalling into the center hole. It will not permit brittle, sudden or catastrophic failure such as occurred in prior art concrete cribbing attempts.

Figure 4:
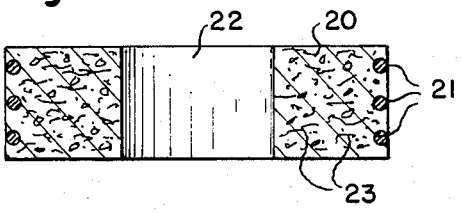
FIG. 4 is a section through a second embodiment of crib member according to my invention.

In FIG. 4 I have illustrated a second embodiment in which a crib member is formed by casting concrete 20 in a removable outer annular mold with spaced reenforcing bars 21 around the periphery of the concrete and cast into the concrete. An opening 22 is formed in the center of the concrete to form a concrete annulus or donut. In this embodiment I have illustrated steel fibers 23 reenforcing the concrete.

Figure 5:
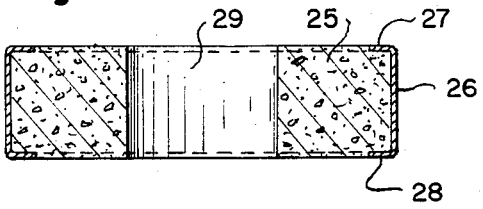
FIG. 5 is a section through a third embodiment of crib member according to my invention.

In FIG. 5 I have illustrated a third embodiment in which concrete 25 is cast with a steel band 26 whose edges 27 and 28 are inturned to form a generally C-shape at the top and bottom of the concrete. An opening 29 is provided in the center of the concrete to form an annulus or donut shape.

Figure 6:
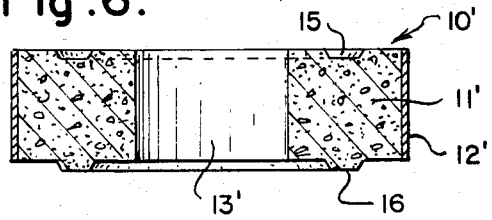
FIG. 6 is a section through a fourth embodiment of crib member according to my invention.

In FIG. 6 I have illustrated a fourth embodiment of my invention based generally on the structure of FIG. 1 with like parts bearing like numerals with a prime sign. In this embodiment the concrete annulus 11' is cast with an annular groove 15 on the top and an annular mating tongue 16 on the bottom and within an outer steel band 12' as in FIG. 1. A central opening 13' is provided to complete the donut shape.

I have found that the use of at least one annular metal retaining member supporting a major portion of the concrete periphery will prevent catastrophic or brittle collapse of the concrete while the central opening permits both reduction in weight coupled with the desired yieldability with necessary support.

In the foregoing specification, I have set out certain preferred practices and embodiments of my invention, however, it will be understood that this invention may be otherwise embodied within the scope of the following claims.

I claim:

1. A yieldable, deformable crib member for use in superimposed layers one upon another as cylindrical hollow cribbing in an underground cavity comprising a portable concrete annulus of greater diameter than height having an unsupported center opening and at least one annular metal retaining member surrounding the outside periphery of said member and firmly attached thereto.

2. A crib member as claimed in claim 1 wherein the metal retaining member is a metal band whose width is equal to the thickness of the crib member.

3. A crib member as claimed in claim 2 wherein the metal band has an inturned flange at each side fitted within and flush with opposed surfaces of the crib member.

4. A crib member as claimed in claim 1 wherein at least one metal retaining member is a plurality of spaced reenforcing rods cast in the outer periphery of said concrete.

5. A crib member as claimed in any one of claims 1 through 4 wherein one of the top and bottom surfaces is provided with an annular groove and the other with a mating annular rib.

6. A crib member as claimed in any one of claims 1 through 4 wherein the metal retaining member is connected at two opposite ends by yieldable fastening means.

7. A crib member as claimed in claim 5 wherein the metal retaining member is connected at two opposite ends by yieldable fastening means.

8. A crib member as claimed in claim 6 wherein the yieldable fastening means is a metal band wrapped transversely around the ends of the retaining member and corrugated over at least a part of its wrapped contact along with the retaining member whereby it will yield frictionally without failure over a substantial distance.

* * * * *

UNITED STATES PATENT AND TRADEMARK OFFICE

CERTIFICATE OF CORRECTION

PATENT NO. : 4,497,597

DATED : February 5, 1985

INVENTOR(S) : NICHOLAS CHLUMECKY

It is certified that error appears in the above-identified patent and that said Letters Patent is hereby corrected as shown below:

Column 3, claim 1, line 1, after for, insert --use in yieldability supporting an overhead load such as a mine roof when--.

Column 3, claim 1, line 1, change "use" to --used--.

Column 3, claim 1, line 8, after thereto, add --, said concrete being of a composition which will provide controlled yielding by spalling into the center opening--.

Signed and Sealed this

*Sixth* Day of *August 1985*

[SEAL]

*Attest:*

DONALD J. QUIGG

*Attesting Officer* *Acting Commissioner of Patents and Trademarks*